United States Patent [19]

Bowley

[11] 4,048,802

[45] * Sept. 20, 1977

[54] FLOATING WAVE BARRIER

[75] Inventor: Wallace William Bowley, Stafford Springs, Conn.

[73] Assignee: William Barney Ritchie, Jr., Duxbury, Mass. ; a part interest

[ * ] Notice: The portion of the term of this patent subsequent to Nov. 19, 1991, has been disclaimed.

[21] Appl. No.: 550,118

[22] Filed: Feb. 14, 1975

Related U.S. Application Data

[63] Continuation-in-part of Ser. No. 485,831, July 5, 1974, abandoned, which is a continuation-in-part of Ser. No. 383,346, July 27, 1973, Pat. No. 3,848,419, which is a continuation-in-part of Ser. No. 357,938, May 7, 1973, Pat. No. 3,846,990, which is a continuation-in-part of Ser. No. 267,086, June 28, 1972, abandoned.

[51] Int. Cl.[2] ..... E02B 3/04

[52] U.S. Cl. ..... 61/5

[58] Field of Search ..... 61/1, 3, 4, 5

[56] References Cited

U.S. PATENT DOCUMENTS

| | | | |
|---|---|---|---|
| 1,432,530 | 10/1922 | Chance | 61/5 |
| 3,022,632 | 2/1962 | Parks | 61/5 |
| 3,222,871 | 12/1965 | Miller et al. | 61/5 |
| 3,534,558 | 10/1970 | Le Bouteiller | 61/5 |
| 3,848,419 | 11/1974 | Bowley | 61/5 |

*Primary Examiner*—Robert L. Wolfe
*Assistant Examiner*—David H. Corbin
*Attorney, Agent, or Firm*—Paul J. Cook

[57] ABSTRACT

A floating anchored wave barrier is provided comprising a plurality of members connected by a flexible line or rigid connecting means. At least one of the members is an inverted vessel having an annulus attached to the periphery of the vessel. The buoyancy and mass of the members are such that when the barrier is placed in water, the top vessel is positioned at or near the water surface and each vessel if partially filled with air. The remaining members can be a vessel having an annulus attached thereto or a disk having a relatively great horizontal extent compared to its thickness. The remaining members are submerged but near the water surface so that they are located within the top portion of the wave where the major portion of the wave kinetic energy is encountered. The top vessel is caused to pitch by the energy of incoming waves and is anchored at or near the axis of pitch to form a wave pattern emanating from the top vessel which impinges upon incoming waves thereby reducing their kinetic energy prior to contact with the members.

15 Claims, 10 Drawing Figures

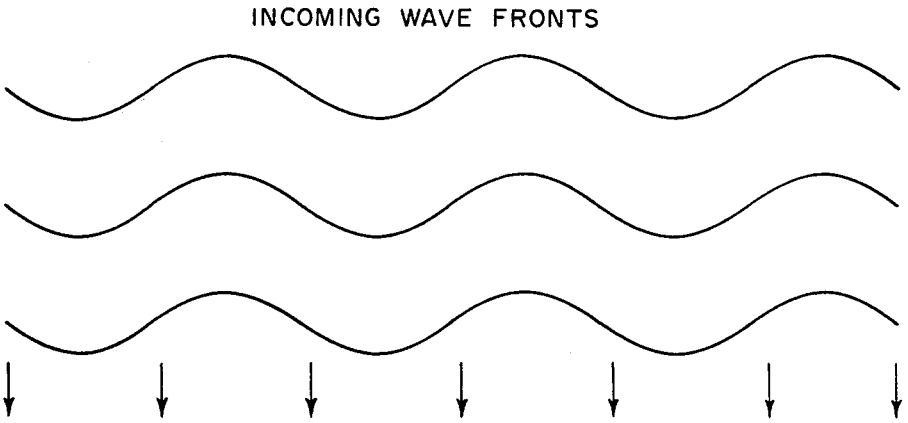
FIG. 5
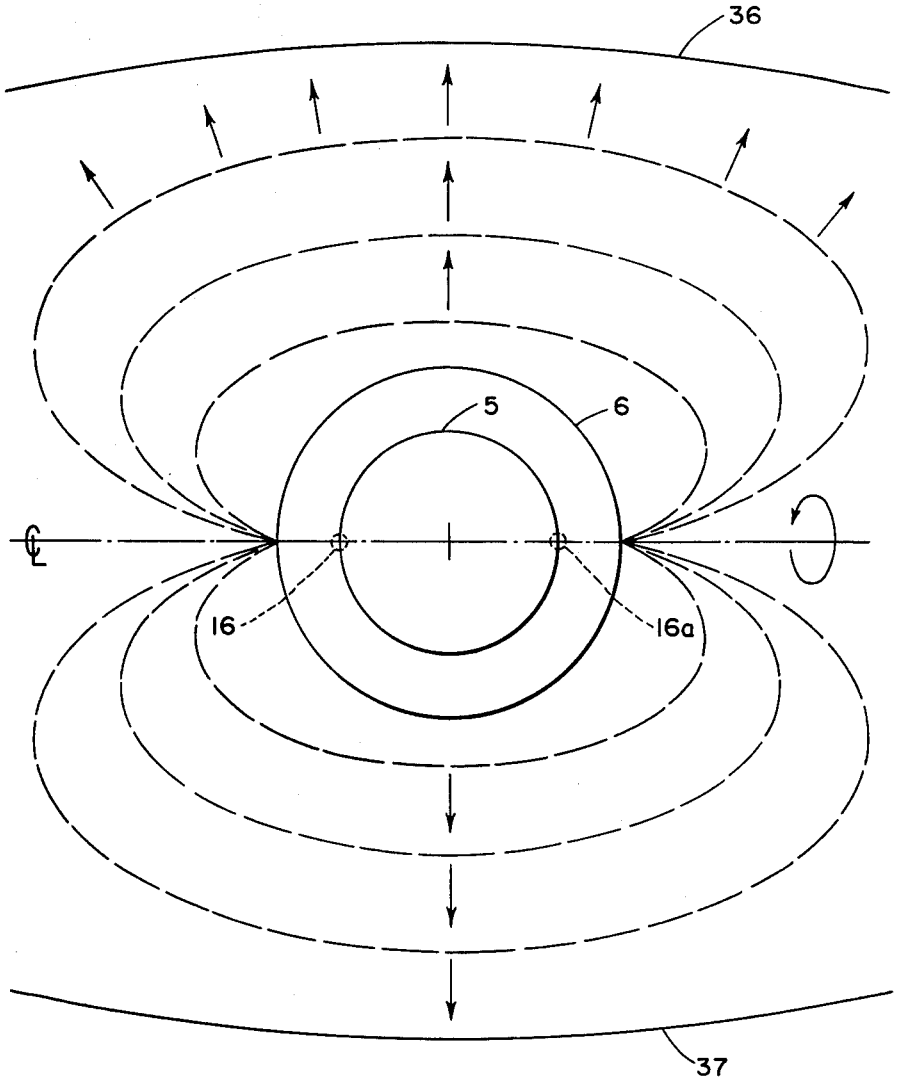

FLOATING WAVE BARRIER

REFERENCE TO RELATED APPLICATION

This application is a continuation-in-part of application Ser. No. 485,831, filed July 5, 1974, now abandoned, which is a continuation-part-in-part of application Ser. No. 383,346, filed July 27, 1973, now U.S. Pat. No. 3,848,419, which is a continuation-in-part application of Ser. No. 357,938, filed May 7, 1973, now U.S. Pat. No. 3,846,990, which in turn is a continuation-in-part of Ser. No. 267,086, filed June 28, 1972, now abandoned.

BACKGROUND OF THE INVENTION

This invention relates to an apparatus for forming a floating wave barrier for reducing or eliminating the kinetic energy of water waves.

Waves are generated at sea by virtue of the frictional drag exerted on the water surface by the wind whereby the small waves originally generated gradually build up to larger waves to form a pattern which progress towards the shore. It has been determined that the water particles making up the wave travel in a circular or elliptical orbit and that the diameter of the orbits at the water surface equal the height of the wave. Furthermore, it has been determined that the diameter of the orbit at a depth of about half the wave length is only about 4 percent of the orbital diameter at the water surface. Thus, substantially all of the kinetic energy of the wave is concentrated at or near the water surface and the percentage of wave kinetic energy located at a given water depth rapidly decreases with water depth. Thus, a water barrier located at or near the water surface and which extends toward the sea bottom a depth of about one-half the expected wave length can be highly effective in diminishing the wave kinetic energy.

In operation, the incident wave strikes the wave barrier which diminishes the kinetic energy of the wave by forming a reflected wave having a finite kinetic energy and allowing a transmitted wave to pass therethrough which has little kinetic energy. It is desirable that the reflected wave kinetic energy be maximized so that it impinges on the other incident waves to decrease their kinetic energy prior to striking the wave barrier. The difference between the kinetic energy of the incident wave and the sum of the transmitted and reflected waves constitutes the kinetic energy absorbed by the wave barrier.

It has been proposed in U.S. Pat. No. 3,353,361 to employ a floating wave barrier comprising a plurality of weighted automobile tires attached with a flexible chain depending from a fixed support so that when placed in water the tires are located at different depths. This wave barrier is undesirable since it functions primarily to reduce the horizontal wave velocity component with little effect on the vertical wave velocity component. Since the net horizontal component is constantly directed landward, there is a constant substantial force on the fixed supports. In contrast, it would be desirable to provide a wave barrier which acts to reduce the vertical wave velocity component since the net vertical component is changing direction constantly and acts over a relatively short distance equal to about one-half the wave length so that the force exerted on the wave barrier anchor is reduced.

The invention disclosed in U.S. Pat. 3,848,419 discloses a floating wave barrier comprising at least one vessel having a top, walls and an open bottom which, when placed in water, has the open bottom submerged. The vessel has at least one plate member attached to the outside surface of the vessel and extending around all or a major portion of the vessel periphery. The vessel or vessels, when placed in water, contain a gas and water. When a plurality of vessels are employed, they are connected with at least one flexible line and one vessel is connected to an anchor on the sea bottom so that when the barrier is placed in water, the vessels are positioned at different vertical levels, with the top member being at or near the surface of the water. The remaining vessels or, if only one vessel is employed, plate members are submerged but near the water surface so that they are located within the top portion of the wave where the major portion of the wave energy is encountered. When placed in water, the vessels and plate members are fixed to prevent substantial movement in the horizontal direction but are free to move in a vertical direction within the wave with the vertical movement of the connected vessels and plate members being out of phase with each other.

The wave barrier disclosed in U.S. Pat. No. 3,848,419 provides excellent wave dampening. However, it would be desirable to improve its performance in reducing kinetic energy of incoming waves.

SUMMARY OF THE INVENTION

The present invention provides a floating wave barrier that can be constructed from the same floating members and in the same arrangement as disclosed in U.S. Pat. No. 3,848,419 or formed from the same or similar buoyant members which are connected with a rigid member or a flexible line and are anchored in a particular manner to greatly improve the efficiency of the floating wave barrier. The floating wave barrier is anchored so that the point or points of attachment of a flexible line or plurality of flexible lines directly or indirectly extending from the anchor is at or near the axis of pitch of the top vessel. The axis of pitch of the top vessel varies with the wave environment to which it is subjected and the attachment point or points of the flexible line to the top vessel is dictated by the average expected wave condition in the area of placement.

The floating wave barrier comprises at least one vessel having a top, walls and a bottom which, when placed in water, has the bottom submerged. The vessel has at least one plate member attached to the outside surface of the vessel and extending around all or a major portion of the vessel periphery. The vessel or vessels, when placed in water, contain a gas and water. When a plurality of vessels are employed, they are connected with at least one flexible line or rigid connection and the top vessel is connected to an anchor on the sea bottom so that when the barrier is placed in water, the vessels are positioned at different vertical levels, with the top member being at or near the surface of the water. The remaining vessels or plate membes are submerged but near the water surface so that they are located within the top portion of the wave where the major portion of the wave energy is encountered. When placed in water, the vessels and plate members are fixed to prevent substantial movement in the horizontal direction but are free to oscillate around its axis of pitch. A plurality of these barriers are arranged substantially parallel to the shore being protected at varying distances from the shore so that a given portion of the wave contacts more than one barrier prior to reaching the shore.

It is not necessary to employ the vessels described above in the wave barrier of this invention. It is only necessary that the top vessel be sufficiently buoyant to maintain its position at or near the water surface and that a plate member be attached to the outside surface of the vessel and extending around all or a major portion of the vessel periphery. For example, the vessel can be partially filled with a buoyant material such as a foamed plastic, e.g., formed polystyrene. When an open-bottom vessel containing a gas is employed, a gas-impermeable flexible web can be attached to the inner surface of the vessel to assure retention of gas within the vessel thereby insuring maintenance of the desired buoyancy.

The wave barrier of this invention dampens incoming waves in that the plate-like annuli on the vessel or vessels act as sources of a series of generlly elliptical wave fronts thereby generating reflected waves in a seaward direction to impinge upon incoming waves. The wave fronts are generated by the pitching motion of the vessel caused by interaction with incoming wave fronts. The generated wave fronts are elliptical in shape, because the motion about the pitch axis causes the plate-like annuli to activate larger amounts of water in proportion to the distance from the axis. The envelope of the emanating, elliptical wave fronts is a roughly linear wave series travelling seaward and shoreward. They are of sufficient height as to trigger an instability in the incoming waves resulting in a premature breaking and resultant dissipation in the region of wave interference. By attaching the anchoring means to the top vessel at or near its axis of pitch, waves generated by the plate-like annulus on the top vessel become significant and function to reduce the vertical velocity component of incoming waves.

BRIEF DESCRIPTION OF THE DRAWINGS

The present invention will be described more fully with reference to the accompanying drawings.

FIG. 5 is a top view of the apparatus of this invention illustrating one form of the mechanics involved in its use.

DESCRIPTION OF SPECIFIC EMBODIMENTS

Figure 2:
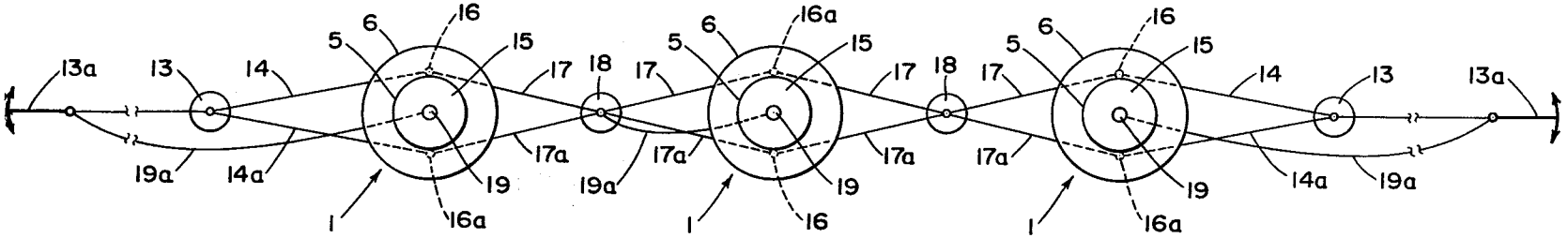
FIG. 2 is a top view of the barrier of FIG. 1.
Figure 1:
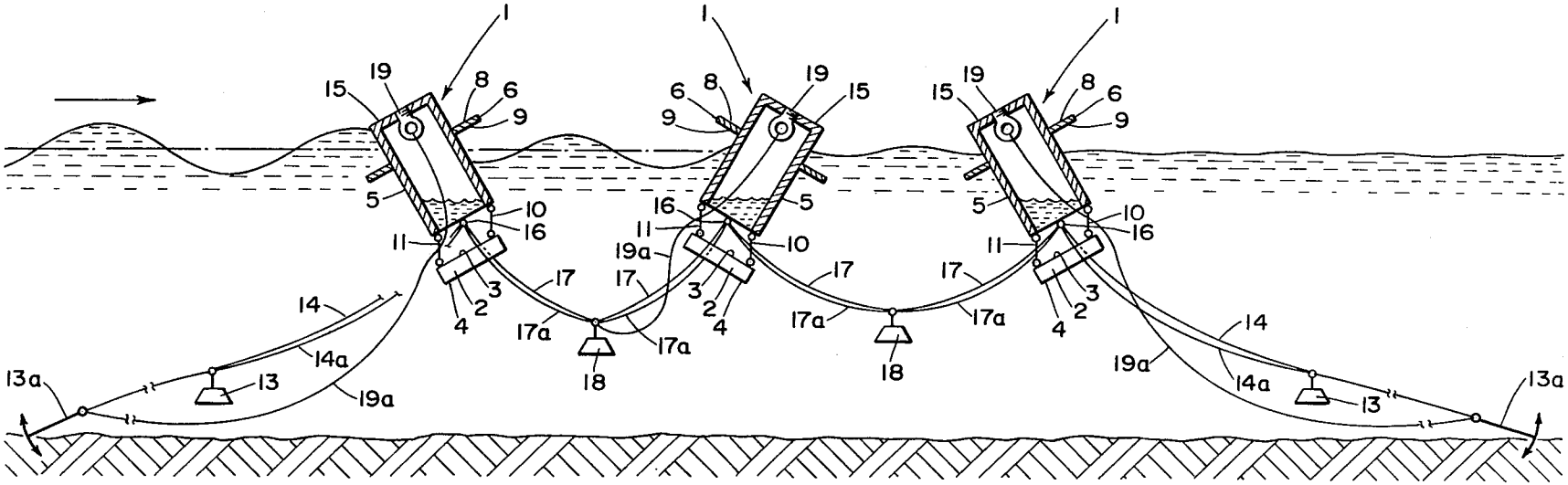
FIG. 1 is a side view of a barrier of this invention in place.

The embodiment shown in FIGS. 1 and 2 comprises a plurality of wave barriers 1, each comprising a disk 2 having a generally rectangular cross section and two circular horizontal flat surfaces 3 and 4 and a hollow vessel 5. The vessel 5 has an annulus 6 attached thereto and extending around the entire periphery of vessel 5. The annulus 6 has a generally rectangular cross section and two circular horizontal flat surfaces 8 and 9. For each barrier 1, the disk 2 and vessel 5 are joined by flexible lines 10 and 11 for example, a rope or chain. The average specific gravity of vessel 5, annulus 6 and disk 2 is such as to permit the vessel, annulus and disk to remain at or near the water surface when submerged. Furthermore, the masses and specific gravity of each disk 2, annulus 6 and vessel 5 are controlled so that they are maintained generally along a common vertical axis with respect to each other while submerged. As shown, the distance between the top 15 of vessel 5 and the bottom surface 4 of disk 2 is about one-half the wave length of the expected waves. This distance can be longer or shorter as desired. However, as noted above, approximately 96 percent of the kinetic energy of the wave is located within this distance.

The vessels are connected to each other by flexible lines 17 and **17*a* which are attached to a common weight 18. Lines 17 and 17*a* are attached to the vessel 5 at the same diametrically opposed points as lines 14 and 14*a* respectively. The weight 18 stabilizes the wave barriers so that they are able to pitch about the axes defined by the connection points for lines 14, 14*a*, 17 and 17*a***.

In one aspect of this invention, but not an essential part thereof, the vessel 5 is provided with a removable plug which extends through the thickness of the top of vessel 5. Plug 19 can be formed from any material, such as lead that can be removed from the wall of the vessel when subjected to a tension force. The plug 19 provides a safety feature for the vessel in that if lines 14 and **14*a* are parted from the anchor 13*a*, tension is applied to line 19*a* by virtue of the wave force thereon which is transmitted to plug 19 so that plug 19 is removed and vessel 5 sinks so that it does not become a hazard to navigation. Line 19*a* is longer than lines 14 and 14*a* so that during normal use of the wave barrier, there is little or no tension on line 19*a***.

The means for anchoring the wave barriers shown in FIG. 1 forms the basis of this invention. The vessels 5 are connected to weights 13 by means of two flexible lines 14 and **14*a*. The lines 14 and 14*a* are attached to two diametrically opposed points 16 and 16*a* on the vessels 5 wherein the points 16 and 16*a* define a line which is or is very near to the axis of pitch of the vessel 5. The actual axis of pitch of the vessel 5 depends primarily upon the wave environment to which the vessel 5 is subjected, the length of lines 10 and 11 and the weight of disk 3. It is to be understood that the actual axis of pitch for a given wave barrier will change in response to its wave environment. However, it has been found that the axis of pitch can be closely approximated by locating the points of attachment of lines 14, 14*a*, 17 and 17*a* on vessel 5 at or within a short distance from its bottom surface. By operating in this manner, the pitching motion of vessel 5** tends to become maximized with resultant formation of interfering waves as described more fully below.

Figure 3:
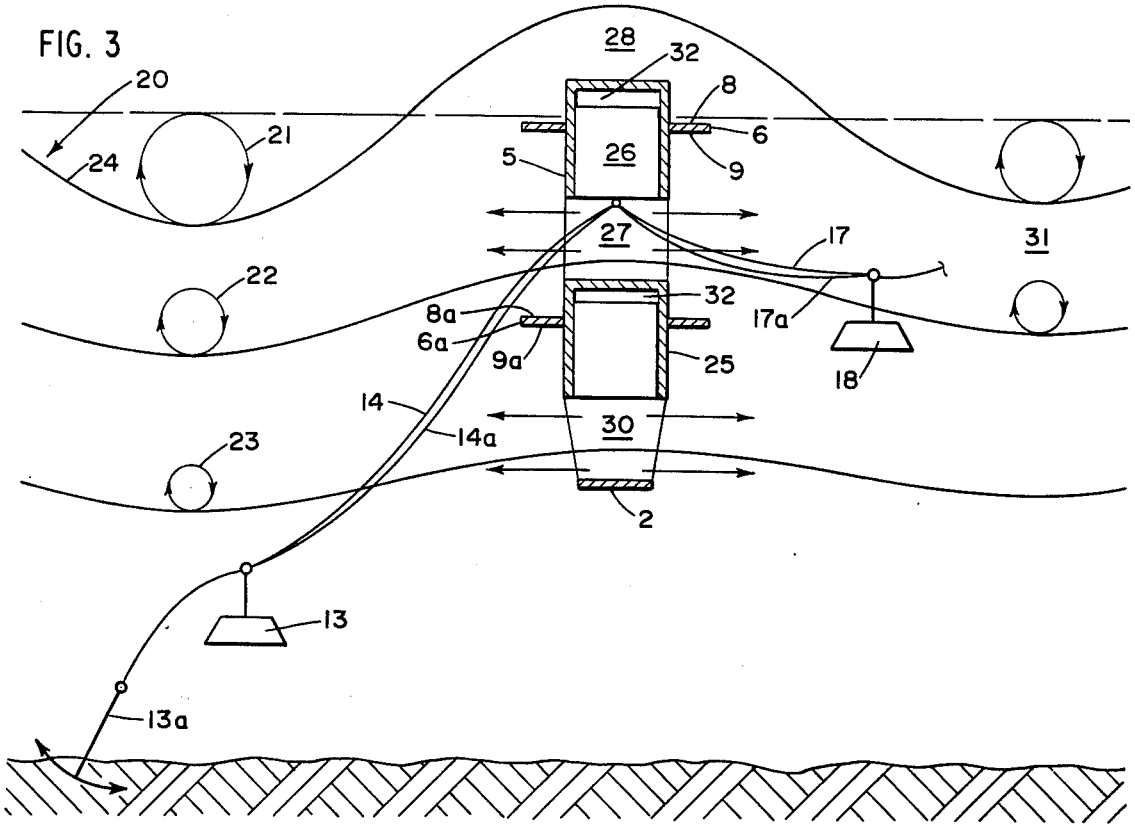
FIG. 3 is a side view of one embodiment of the apparatus of this invention.

An alternative embodiment of this invention is described with reference to FIG. 3. The kinetic energy and circular orbits of the water particles in the wave 20 are represented by the circles 21 and 22 and 23 with circle 21 having the largest diameter since the particles have a greater kinetic energy nearer the surface 24 of the wave 20. The vessel 5 pitches about axis 16 by virtue of its contact with waves prior to wave 20 which pitching motion also causes vessel 25 to pitch. The pitching motion of vessels 5 and 25 causes annuli 6 and 6a to act as paddles to form a wave front that impinges upon incoming waves 20. This reduces their kinetic energy so that the waves 31 that have passed the vessels 5 and 25 are smaller. The plate 2 serves to stabilize the vessels 5 and 25 and also is caused to pitch by virtue of the pitching motion of vessels 5 and 25.

The mechanism by which the wave barrier of this invention reduces the vertical velocity component is described with reference to FIG. 5. It is desirable that the wave barrier form a reflected wave to reduce the kinetic energy of incoming waves and to produce a transmitted wave to fill in a wave trough which is adjacent to and past the wave barrier. Annulus 6 attached to vessel 5 acts as a paddle which generates waves when the vessel 5 moves vertically within the wave and, most importantly, when the vessel pitches about the axis defined by points 16 and 16a. The annulus 6 generates small, generally elliptical wave fronts and the generated waves formed from adjacent wave barriers contact and coalesce to form a reflected wave 36 which impinges upon incoming waves to reduce their kinetic energy prior to contacting a wave barrier. In addition, a wave 37 is formed by the coalescence of waves generated by annuli 6 from adjacent wave barriers. The wave 37 tends to fill-in the trough of waves having passed the wave barriers thereby to reduce the vertical velocity component of waves transmitted through the first set of wave barriers.

Figure 4:
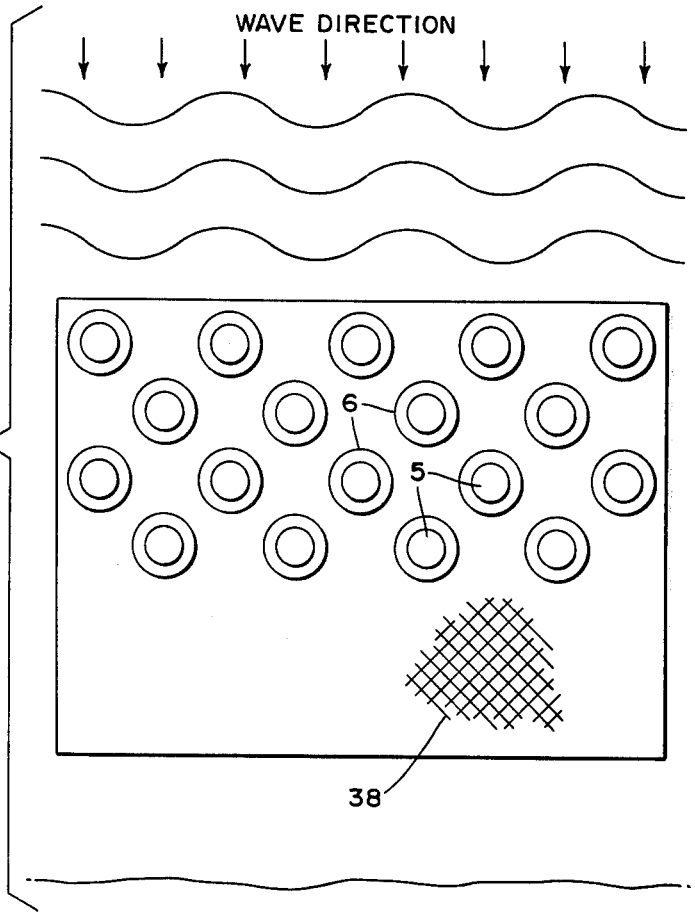
FIG. 4 is a top view showing one configuration of the wave barrier system of this invention.

Referring to FIG. 4, a configuration is shown wherein each wave barrier is not fastened to any other wave barrier but is fastened with a flexible line from two diametrically opposed points on the vessel 5, as shown in FIGS. 1 and 2 and anchored to a net 38 located and fastened to the ocean bottom. The barriers are placed a suitable distance from the shore line so that they contact deep water waves but not so far as to allow the dampened waves to build-up kinetic energy prior to reaching the shore. To attain relatively complete wave dampening, the barriers are placed within about three of the combined diameters of the vessel 5 and annulus 6 from each other. The barriers are anchored so that the axis of pitch of each wave barrier is generally perpendicular of the waves travelling toward the shore thereby promoting the pitching motion of the barrier.

Figure 6:
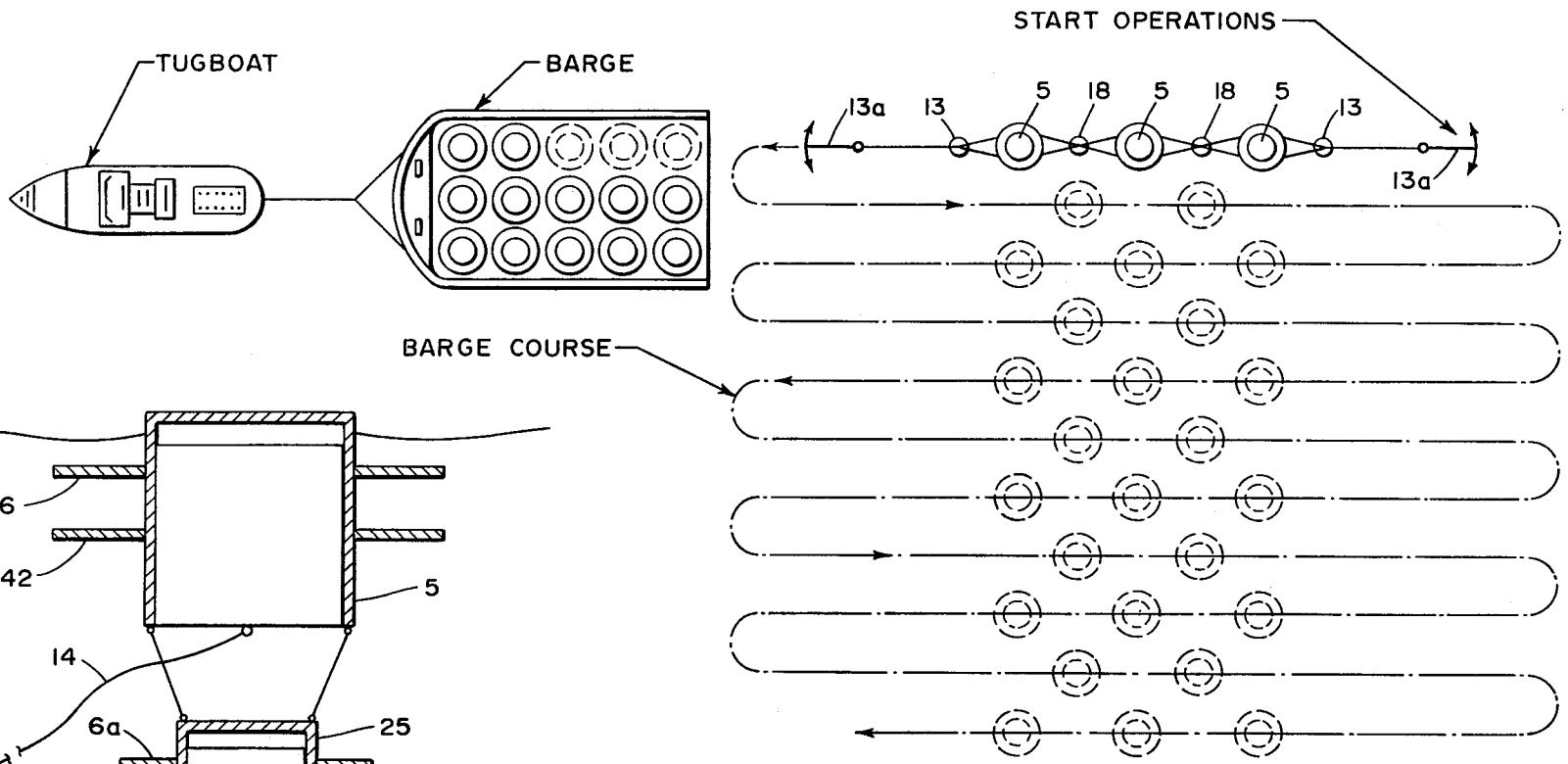
FIG. 6 is a top cross-sectional illustrating a method for constructing a complete wave barrier system.

A desirable mode for placing the wave barrier of this invention in the water is depicted by FIG. 6. As shown in FIG. 6, a floating wave barrier system is formed with groups of two or three wave barriers joined together with flexible lines and to anchors as shown in detail in FIGS. 1 and 2. A barge containing the wave barriers is towed along a desired path by a tugboat. At desired predetermined areas, a set of wave barriers comprising either three floating wave barriers and two anchors or two floating wave barriers and two anchors are placed in the water. The axis of pitch of the wave barriers is generally perpendicular to the direction of incoming waves toward the shore.

Figure 8:
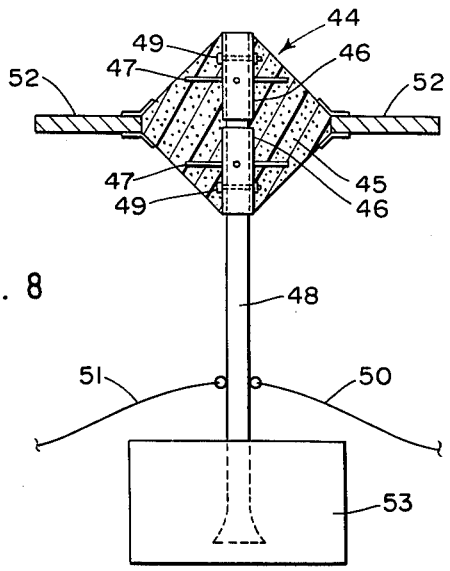
FIG. 8 is a side cross-sectional view of a barrier connected to a counterweight with a rigid connecting rod.

Referring to FIG. 8, a wave barrier 44 is formed from a top buoyant member having a generally diamond-shaped body 45 which can be formed, for example, from fiber glass and a polyester binder. The body 45 contains two strengthening members, each comprising a cylindrical hub 46 having spokes 47 which extend into the body 45. Each of the hubs 46 are attached to rigid rod 48 by means of bolts 49. The rod 48 can be formed of any strong, relatively rigid material such as metal or fiber glass. The rod 48 is attached to a counterweight 53 such as by molding cement around the flared bottom portion of the rod 48. Anchor lines 50 and 51 are attached to the rod 48 at the expected axis of pitch of the barrier 44. The plate 52 is joined to the body 45 by any suitable means such as with a fiber glass-polyester adhesive.

Figure 9:
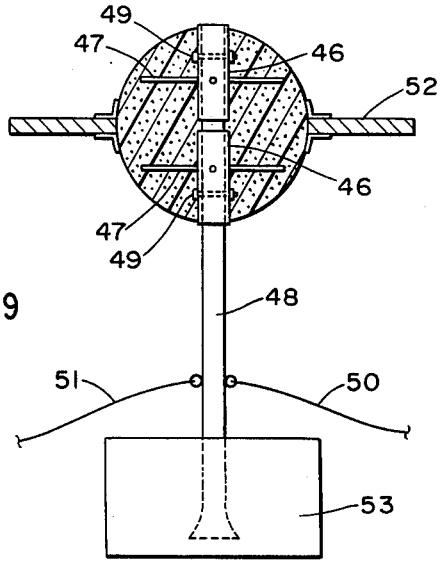
FIG. 9 is a side cross-sectional view of an alternative barrier configuratin connected to a counterweight with a rigid connecting rod.

The wave barrier shown in FIG. 9 is of the same construction as the barrier shown in FIG. 8 except that the body 45 has a sphericl shape. Alternatively, the body can be cylindrically shaped. It is to be understood that the shape of the body 45 is not critical to this invention. All that is required is that it be sufficiently strong to support the plate 52 and that it have the desired buoyancy.

Figure 10:
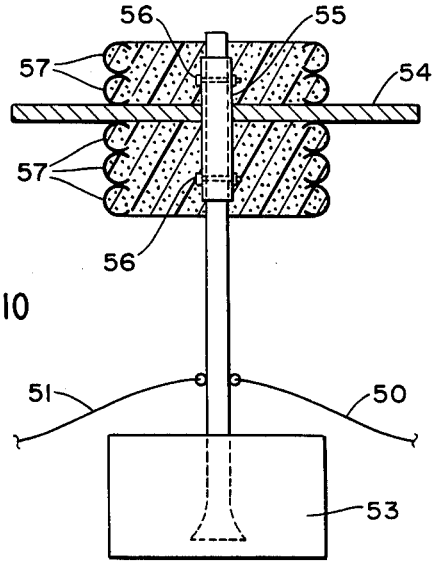
FIG. 10 is a side cross-sectional view of an alternative barrier configuration connected to a counterweight with a rigid connecting rod.

Referring to FIG. 10, an alternative wave barrier construction is shown which can be constructed from rubber tires. The rod 48 and counterweight 53 as well as the position of the anchor lines 50 and 51 are constructed in the same manner as described for the construction shown in FIG. 8. The plate 54 is attached to the rod 48 by inserting the rod 48 into the hub 55 and bolting the hub 55 to the rod 48 with bolts 56. Tires 57 then are positioned adjacent the plate 54 at the position shown and the interior of the tires 57 and then filled with a suitable strengthening composition such as a fiber glass-polyester composition which, when cured, results in the unitary construction shown.

The wave barriers described in FIGS. 8 through 10 are placed in the water in the same configuration and by essentially the same means employed for the wave barriers formed with flexible lines. Furthermore, it is to be understood that the wave barriers shown in FIGS. 8 through 10 can be provided with more than one disk or annulus.

The mass and buoyancy of the individual vessels and disks which are attached with flexible lines are controlled to maintain the generally vertical spaced-apart relationships and the vertical movement of the vessels and disks in water described above. In addition, the vessels and disks are spaced apart along a flexible line a distance so that they do not contact during use but are sufficiently close to effect dampening of the vertical wave component by the mechanisms described above. For example, in areas where 4 to 5 foot water waves are expected, the vessels and disks are spaced apart a distance of about 12 to 15 feet. In smaller waves, the distance between plates is less than 3 to 4 feet and in larger waves the distance is greater than 40 to 50 feet. The distance between vessels or disk buoyancy and mass can be determined easily by calculating the forces on the vessels and disks and the forces exerted by the moving vessels and disks. Generally the weights 18, are between about 50 and 300 pounds each.

It is to be understood that the vessels can be of the same size or different sizes. When employing the construction shown in FIGS. 1 through 3 and 7, it is preferred that the vessels nearest the surface have the largest volume and the bottom vessel have the smallest volume with the intervening vessels gradually being smaller as a function of water depth because the vessels at the lower depths encounter a reduced portion of the wave kinetic energy as compared to the vessels at or near the surface and the cost of increasing their size generally is not justified.

The size of the vessels and disks employed can be varied widely. Exemplary suitably sized vessels in areas where 4 to 5 foot water waves are expected have a volume of about 340 to 450 cubic feet, a height of about 12 to 16 feet and a diameter of about 5 to 7 feet. The annulus attached to a vessel has a ratio of major effective diameter (including the diameter of the vessel) to its vertical dimension of at least about 20 to 1. In small waves, the volume, height and diameter of the vessel could be less while in larger waves, the volume, height and diameter of the vessel could be larger.

As noted above, the vessel can be employed in conjunction with one or more additional vessels to form a wave barrier or can be employed with one or more disks. When employed with one or more disks, the vessel comprises the top member of the wave barrier. In any case, a disk should be positioned adjacent the bottom of the lowermost vessel to coact therewith in the manner described above unless the bottom of the lowermost vessel extends below the water level wherein the significant portion of the wave kinetic energy is encountered, i.e., one-half the wavelength. When the bottom of the lowermost vessel extends to a water level greater than one-half the wavelength disks, can be interposed between vessels at a vertically intermediate water depth.

When individual disks are employed, the ratio of disk major effective diameter to its vertical dimension should be at least about 10 to 1 to attain effective wave dampening. Each disk or vessel can be modified to position the center of gravity thereof as desired. Thus, the periphery on either surface of a disk either along or attached to a vessel can be formed of a material having a different density than the average density of the disk. It has been found desirable to form the periphery of the disk from a material having a higher density than the average disk density thereby to increase the mass at the periphery and increase the moment of inertia of the disk.

Figure 7:
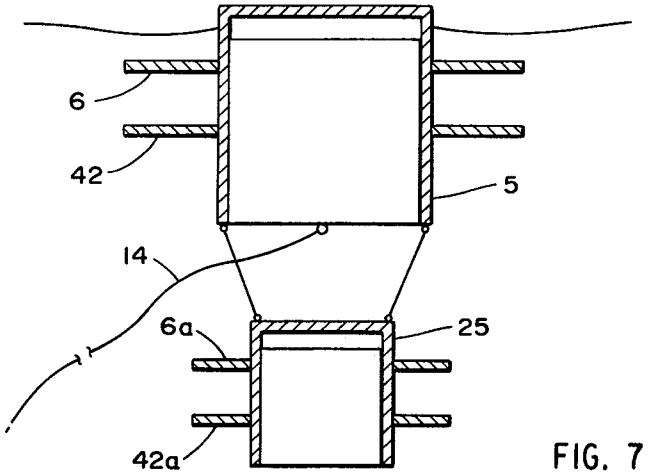
FIG. 7 is a side cross-sectional view of an alternative embodiment of this invention.

An alternative embodiment is shown in FIG. 7 wherein each vessel 5 and 25 has a plurality of annuli 6 and 42 and **6*a* and 42*a***. When a plurality of annuli are attached to a vessel, they function to trap water therebetween and increase the inertia of the system. Generally the annulus on the vessel are spaced apart a distance of about one-half the diameter of the vessel.

It is to be understood that the disk and annulus configurations shown in the drawings are only representative of a large number of configurations that can be employed. All that is needed is that the disk or annulus has two surfaces which have a relatively great horizontal extend compared to its thickness to obtain the desired effect namely, the generation of waves by pitching and to prevent substantial bypass of water around the disk or annulus. Thus the disk or annulus surfaces can be flat, slightly concave, slightly convex, corrugated, etc., and still prevent substantial undesirable water by-pass. In addition, these surfaces need not be circular but can elliptical, polygonal, etc.

Further, it is to be understood that the lines 14 and **14*a*, 17 and 17*a* need not be attached to the wall of the vessel 5** so long as they are attached along a line comprising or approximating the axis of pitch. For example, a bar could be attached at or near the bottom portion of the vessel and extending through the diametrically opposing points on the vessel and the flexible lines could be attached to the bar.

I claim:

1. A wave barrier having a top member and a second member attached to said top member, said top member having at least one annulus extending from a body portion of said top member, said second member being positioned at a deeper water depth than said top member when said barrier is anchored in water, said top member being located at or near the water surface, said second member being submerged near the water surface, the masses and specific gravity of the top member, annulus and second member being controlled so that the top member and second member are maintained generally along a common vertical axis with respect to each other when placed in water, said barrier being anchored to the sea bottom by a flexible line extending from an anchor to a point at or near to an axis of pitch of said top member in order to maximize oscillation of said top member about said axis of pitch and so that said annulus causes formation of wave fronts to contact incoming waves to reduce a vertical wave velocity component of the incoming waves and without substantial contact of said members, said axis of pitch being determined under the average expected wave condition in the water, and said axis of pitch being oriented in a direction generally perpendicular to the direction of movement of incoming waves toward the shore when said barrier is anchored in water.

2. The wave barrier of claim 1 comprising a plurality of members, at least one of said members comprising a vessel having a closed top, a bottom and at least one annulus secured to the exterior of the vessel, the remainder of said members being a disk or one of said vessels having at least one annulus attached to the exterior of the vessel, said members being flexibly suspended to each other and, when anchored in water, having a configuration such that the members are located at different vertical levels along a common vertical axis and each vessel has its bottom at a lower water level than its top and wherein said top member is one of said vessels, and each of said disks being of relatively great horizontal extent compared to its vertical dimension.

3. The wave barrier of claim 2 wherein the distance between the top of the top member and the bottom of the lowermost member is about one-half the wave length of normal waves in which the barrier is positioned.

4. The wave barrier of claim 2 having two vessels each having at least one annulus attached to the exterior of the vessels and a disk flexibly suspended from a vessel, said disk comprising the vertically lowermost member when the barrier is placed in water.

5. The wave barrier of claim 3 having two vessels each having at least one annulus attached to the exterior of each vessel and a disk flexibly suspended from a vessel, said disk comprising the vertically lowermost member when the barrier is placed in water.

6. The wave barrier of claim 1 wherein said top member and said second member are connected with a rigid connecting means.

7. The wave barrier of claim 6 having a plurality of annuli attached to and extending from said top member.

8. Apparatus for reducing or eliminating the vertical kinetic energy of water waves on a shore line comprising a plurality of sets of the wave barriers of claim 1 positioned generally paralleled to the shore line at different distances from the shore line so that a given portion of an incident wave contacts at least two of said barriers each of said sets comprising at least two of said wave barriers and two end barriers within each set, wherein adjacent barriers within a set are connected to a common weight attached to a flexible line extending from a point on or near the axis of pitch from the top member of each barrier and wherein the end wave barriers within each set are anchored to the sea bottom by a flexible line extending to a point at or near the axis of pitch for the top member of each of said end barriers, in order to maximize oscillation of each top member about their respective axis of pitch.

9. Apparatus for reducing or eliminating the vertical kinetic energy of water waves on a shore line comprising a plurality of sets of the wave barriers of claim 2 positioned generally paralleled to the shore line at different distances from the shore line so that a given portion of an incident wave contacts at least two of said barriers, each of said sets comprising at least two of said wave barriers and two end barriers within each set, wherein adjacent barriers within a set are connected to a common weight attached to a flexible line extending from a point on or near the axis of pitch for the top member of each barrier and wherein the end wave barriers within each set are anchored to the sea bottom by a flexible line extending from an anchor to a point at or near the axis of pitch for the top member of each end barrier in order to maximize oscillation of each top member about their respective axis of pitch.

10. Apparatus for reducing or eliminating the vertical kinetic energy of water waves on a shore line comprising a plurality of sets of the wave barriers of claim 6 positioned generally paralleled to the shore line at different distances from the shore line so that a given portion of an incident wave contacts at least two of said barriers, each of said sets comprising at least two of said wave barriers and two end barriers within each set, wherein adjacent barriers within a set are connected to a common weight attached to a flexible line extending from a point on or near the axis of pitch for the top member of each barrier and wherein the end wave barriers within each set are anchored to the sea bottom by a flexible line extending from an anchor to a point at or near the axis of pitch for the top member of each of said barriers in order to maximize oscillation of each top member about their respective axis of pitch.

11. Apparatus for reducing or eliminating the vertical kinetic energy of water waves on a shore line comprising a plurality of sets of the wave barriers of claim 7 positioned generally paralleled to the shore line at different distances from the shore line so that a given portion of an incident wave contacts at least two of said barriers, each of said sets comprising at least two of said wave barriers and two end barriers within each set, wherein adjacent barriers within a set are connected to a common weight attached to a flexible line extending from a point on or near the axis of pitch for the top member of each barrier and wherein the end wave barriers within each set are anchored to the sea bottom by a flexible line extending from an anchor to a point at or near the axis of pitch for the top member of each of said end barriers in order to maximize oscillation of each top member about their respective axis of pitch.

12. The apparatus of claim 8 wherein said barriers are anchored to a net secured to the sea bottom.

13. The apparatus of claim 9 wherein said barriers are anchored to a net secured to the sea bottom.

14. The apparatus of claim 10 wherein said barriers are anchored to a net secured to the sea bottom.

15. The apparatus of claim 11 wherein said barriers are anchored to a net secured to the sea bottom.

* * * * *